United States Patent [19]

Rider, Jr.

[11] Patent Number: 4,822,299

[45] Date of Patent: Apr. 18, 1989

[54] INSULATOR HOUSING HAVING OPERATING MEMBER

[75] Inventor: Frederick H. Rider, Jr., Youngstown, Ohio

[73] Assignee: General Motors Corporation, Detroit, Mich.

[21] Appl. No.: 671,453

[22] Filed: Nov. 14, 1984

[51] Int. Cl.[4] ..... H01R 4/24

[52] U.S. Cl. ..... 439/402

[58] Field of Search ..... 339/97 R, 97 P, 98, 339/99 R

[56] References Cited

U.S. PATENT DOCUMENTS

| | | | |
|---|---|---|---|
| 3,388,367 | 6/1968 | Brown | 339/97 P |
| 3,865,460 | 2/1975 | Cherney et al. | 339/98 |
| 3,868,161 | 2/1975 | Frantz | 339/97 R |
| 3,890,029 | 6/1975 | Izareli | 339/98 |
| 3,899,236 | 8/1975 | Santos | 339/98 |
| 3,910,672 | 10/1975 | Frantz | 339/97 P |
| 4,045,112 | 8/1977 | Rodondi et al. | 339/99 R |
| 4,160,575 | 5/1979 | Schraut | 339/103 M |
| 4,195,898 | 4/1980 | Chow et al. | 339/99 R |
| 4,496,206 | 1/1985 | Markwardt et al. | 339/98 |

*Primary Examiner*—Joseph H. McGlynn

*Attorney, Agent, or Firm*—Francis J. Fodale

[57] ABSTRACT

An electrical component is packaged in an insulator housing which has insulation displacement terminals and operating members to facilitate field assembly to insulated conductors. The operating members are integrally connected to a hinged over of the housing by frangible webs and forced down into the body to connect the insulated conductors to the insulation displacement terminals.

6 Claims, 2 Drawing Sheets

INSULATOR HOUSING HAVING OPERATING MEMBER

This invention relates generally to thermoplastic insulator housings and more particularly to thermoplastic insulator housings for terminals having insulation displacement portions for connecting the terminals to insulated conductors.

The object of this invention is to provide an insulator housing which carries its own operating member for forcing the insulated conductor into operating engagement with the insulation displacement portion of the terminal.

A feature of the invention is that operating member is connected to a hinged cover of the insulator housing by frangible webs so that the operating member is an integral part of the housing and yet operates independently of the cover.

Another feature of the invention is that the insulator housing is particularly adapted for field installation.

Yet another feature of the invention is that the operating member is placed near an edge of the hinged cover so the operating member can be actuated by an ordinary pair of pliers.

Still another feature of the invention is that the operating member is retained in the insulator housing after actuation to provide a strain relief for the insulated conductor.

Still yet another feature of the invention is that the hinged cover may be opened for inspecting the interior of the insulator housing after the operating member has been actuated and retained in the body whereby the insulator housing is particularly useful for packaging electrical components such as diodes, capacitors, resistors and the like.

Still yet another feature of the invention is that the hinged cover has an upright U-shaped guard wall for protecting the actuating member against accidental separation prior to actuation.

Other objects and features of the invention will become apparent to those skilled in the art as the disclosure is made in the following detailed description of a preferred embodiment of the invention as illustrated in the accompanying sheets of drawings in which.

Figure 1:
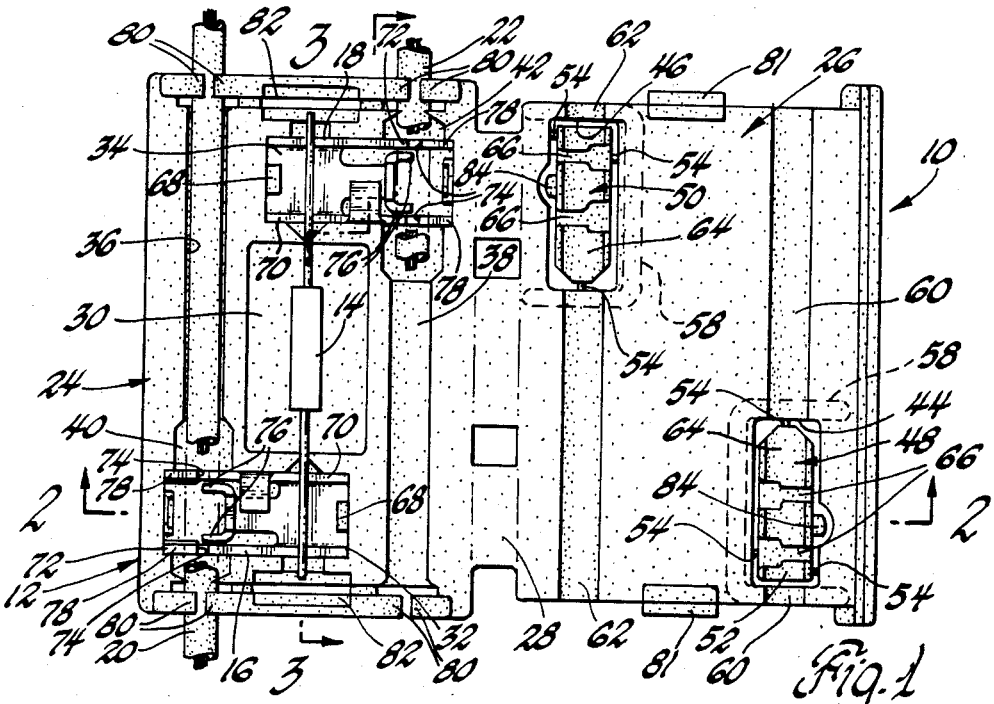
FIG. 1 is a top view of an electrical component package having an insulator housing which is in accordance with this invention and which is illustrated with a hinged cover in an open position.
Figure 2:
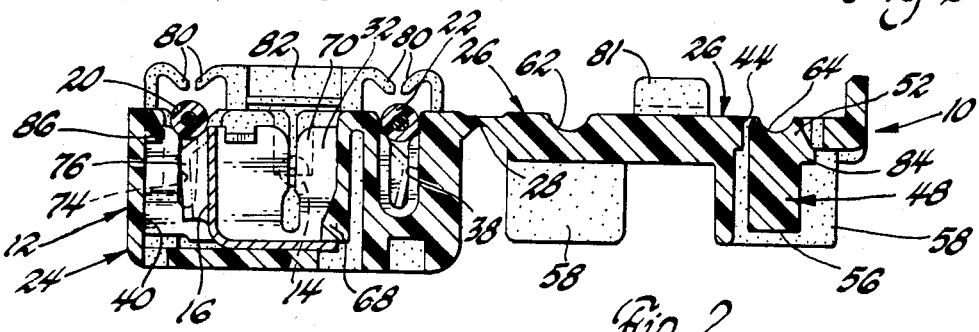
FIG. 2 is a transverse section taken substantially along the line 2—2 of FIG. 1 looking in the direction of the arrows.
Figure 3:
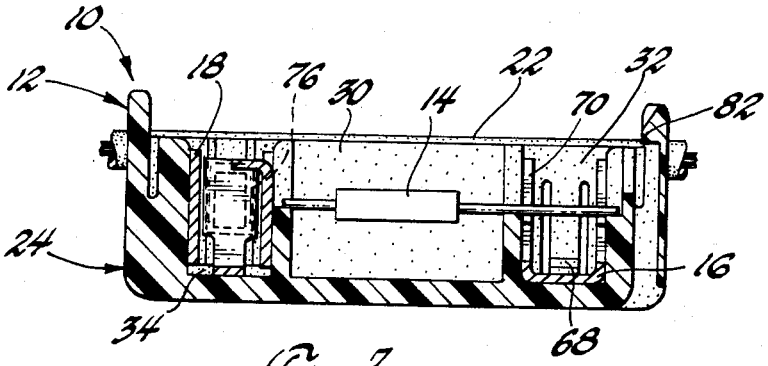
FIG. 3 is a longitudinal section taken substantially along the line 3—3 of FIG. 1 looking in the direction of the arrows.

Referring now to the drawing and more particularly to FIGS. 1, 2 and 3, the invention is illustrated as being embodied in an electrical component package 10 which comprises an insulator housing 12, an electrical component 14, and a pair of insulation displacement terminals 16 and 18. The electrical component package 10 is particularly well adapted for field installation onto a pair of insulated conductors 20 and 22 as will hereinafter more fully appear.

The insulator housing 12 is molded of a thermosplastic material and comprises a body 24 and a cover 26 which is integrally hinged to the body by a flexible hinge portion 28 which in this particular instance is molded in three separated sections. The cover 26 is molded in an open position which is illustrated in FIGS. 1, 2 and 3 and the cover 26 is moveable about the hinge 28 from the open position to a closed position which is illustrated in FIGS. 4, 5, 6, 7, 8 and 9.

The plastic body 24 has a central component chamber 30, and terminal cavities 32 and 34 which are at the opposite ends of the component chamber 30 in the longitudinal direction of the body. The plastic body 24 also has a pair of parallel conductor channels 36 and 38 which run in the longitudinal direction on either side of the central chamber 30 and which extends through the transverse sidewalls at each end of the plastic body 24. The terminal cavity 32 intercepts the conductor channel 36 and the body 24 has a terminating chamber 40 at the juncture of the terminal cavity 32 and the conductor channel 36. Similarly, the terminal cavity 34 intercepts the conductor channel 38 and the body 24 has a second terminating chamber 42 at the juncture of the terminal cavity 34 and the conductor channel 38. The cover 26 has a pair of apertures 44 and 46 which extend through the cover and which align with the terminating chambers 40 and 42 respectively, when the cover is in a closed position.

Figure 4:
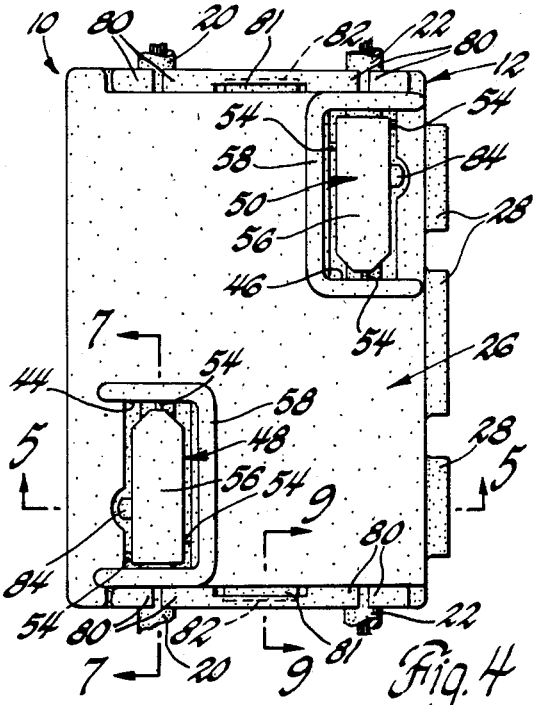
FIG. 4 is a top view of the electrical component package showing the cover in the closed position.
Figure 5:
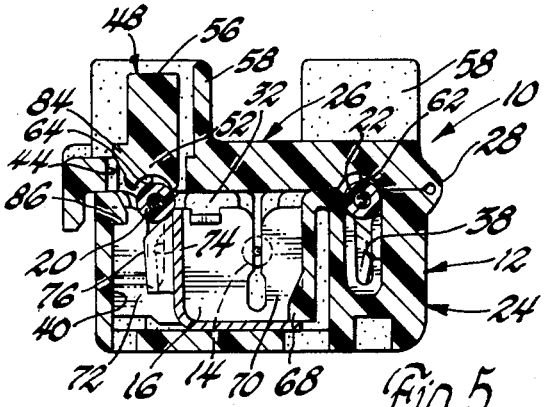
FIG. 5 is a transverse section taken subtantially along the line 5—5 of FIG. 4 looking in the direction of the arrows and showing an operating member of the cover positioned for actuation to force an insulated conductor into operating engagement with an insulation displacement terminal inside the housing.
Figure 7:
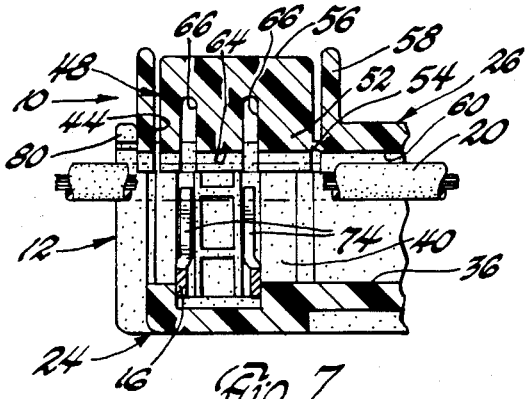
FIG. 7 is a longitudinal section taken substantially along the line 7—7 of FIG. 4 looking in the direction of the arrows and showing the operating member before actuation.

The insulator housing 12 has two "breakaway" operating members 48 and 50 which are integrally attached to the cover 26 as shown in FIGS. 1, 2, 4, 5 and 7. The "breakaway" operating member 48 has one end 52 which is disposed in the aperture 44 and integrally connected to the cover 26 by a plurality of frangible webs 54 as best shown in FIG. 1. The operating member 48 projects outwardly of the cover and terminates in a free end 56 which is spaced outwardly of the outer surface of the cover 26 as best shown in FIGS. 2, 5 and 7. The operating member 48 is protected by an upstanding U-shaped guard wall 58 of the cover 26 so that the operating member 48 is not accidentally separated from the cover 26 during handling.

The cover 26 has longitudinal grooves 60 and 62 which extend from end-to-end and intercept the apertures 44 and 46 respectively. The longitudinal grooves 60 and 62 respectively align with the conductor channels 36 and 38 of the body 24 when the cover 26 is closed as shown in FIGS. 4 through 9. The web attached end 52 of the operating member 48 has a groove 64 matching the groove 60 of the cover 24 and slots 66 which are shaped to fit around the insulation displacing portion of the terminal 16 when the operating member 48 is actuated. The structure of operating member 46 is identical to that of the operating member 44 so it need not be described in detail.

The terminal 16 is retained in the terminal cavity 32 by a latch finger 68 which engages the base of the terminal 16. The terminal 16 is described in detail in pending patent application Ser. No. 526,687 filed by John Chupak, Aug. 26, 1983, and assigned to the assignee of this invention. Briefly the terminal 16 has a slotted end 70 for connection to a lead of the electric component 14 and an insulation displacement portion 72 which comprises a pair of side walls having guide slots 74 and a flex arm which has blades 76 for piercing the insulation of the insulated conductor 20 in cooperation with the legs 78 at one side of the guide slots 74 to establish four point contact with the conductive core of the insulated conductor. The structure of the terminal 18 is identical and the terminal 18 is similarly retained in the terminal cavity 34 for connection to the other lead of the electric component 14 and to the other insulated conductor 22 by means of the operating member 50. The conductors 20 and 22 are connected to the terminals 16 and 18 by the operating members 48 and 50 in an identical manner so the description of one will suffice.

The insulated conductor 20 is attached to the insulation displacement portion 72 of the terminal 16 in the following manner. The insulated conductor 20 is pushed past two pairs of flexible fingers 80 of the plastic body 24 which are at the respective ends of the conductor channel 36 and rested on the insulation displacement portion 72 of the terminal 16 as shown in FIGS. 1 and 2.

Figure 8:
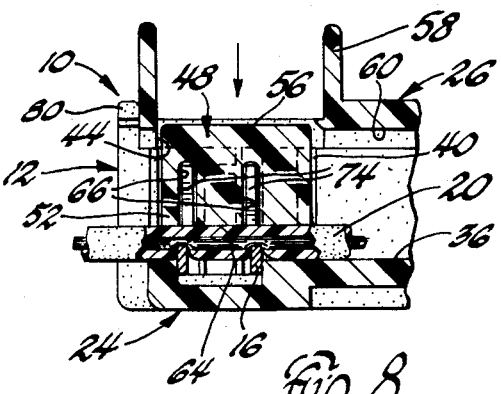
FIG. 8 is a longitudinal section similar to FIG. 7 showing the operating member retained after actuation.
Figure 9:
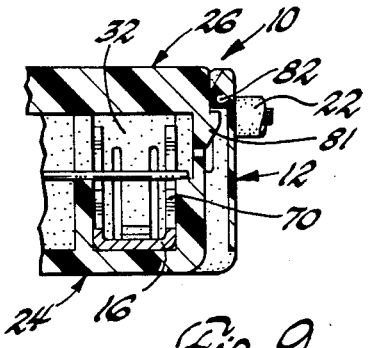
FIG. 9 is a longitudinal section taken substantially along the line 9—9 of FIG. 4 looking in the direction of the arrows and showing the cover locking detail.

The cover 26 is then pivoted about the hinge 28 to the closed position shown in FIGS. 4 through 9. The cover 26 is retained in the closed position by nibs 81 at each end of the cover engaging beneath cooperating nibs 82 of the respective center portions of the transverse sidewalls of the plastic body 24 which are between the channels 36 and 38 as best shown in FIG. 9.

The insulated conductor 20 is now securely retained in the proper position between the covers 26 and the body 24 where the groove 64 of the operating member 48 engages the insulated conductor 20 on one side and the insulating displacement portion 72 of the terminal 16 engages it on the other side as shown in FIGS. 4, 5 and 7.

Figure 6:
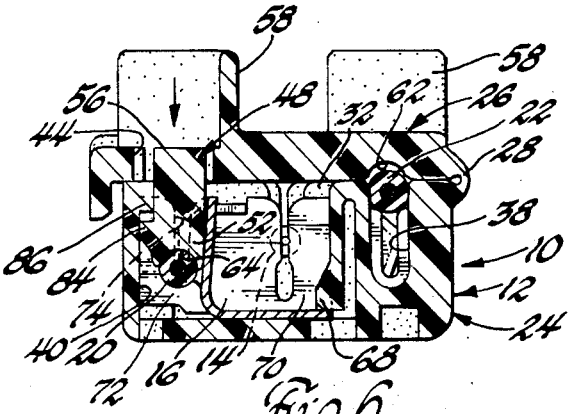
FIG. 6 is a transverse section similar to FIG. 5 showing the operating member retained in a terminating chamber inside the housing after the operating member has been actuated.

The operating member 48 is then actuated by applying a downward force to the free end 56 which breaks the frangible webs 54 and pushes the operating member 48 down into the terminating chamber 40. During translation, the operating member 48 forces the insulated conductor 20 down into the insulating displacement portion 72 of the terminal 16 as shown in FIGS. 6 and 8. The operating member 48 is retained in the actuated position by a nib 84 engaging a cooperating nib 86 of the body 24 as shown in FIG. 6. When thus retained, the operating member 48 acts as a strain relief for the insulated conductor 20 which is connected to the terminal 16.

It should be noted that the terminating chamber 40, aperture 44, and opening of the guard wall 58 are near the side of the insulator housing 12 which is parallel to the channel 36 and conductor 20 so that the operating member 48 can be actuated by an ordinary pair of pliers.

It should also be noted that the free end 56 of the operating member 48 is substantially flush with the outer surface of the cover 26 in the actuated position which provides a signal of a properly actuated operating member. The perimeter of the free end 56 is also spaced from the aperture 44 by a sufficient amount so that the cover 26 can be opened for inspecting the inside of the housing 12 after the operating member 48 has been actuated and retained in the terminating chamber 40.

When the invention is used to package an electric component, the electric component 14 and the terminals 16 and 18 would normally be installed at the factory. The package is then easily installed in the field simply by positioning the insulated conductors 20 and 22 under the flexible fingers 80 and over the terminals 16 and 18 respectively; closing the cover 26; and actuating the operating members 48 and 50 by an ordinary pair of pliers.

The embodiments of the invention in which an exclusive property or privilege is claimed are defined as follows:

1. An insulator housing for an insulation displacement terminal comprising:

a body and a cover integrally hinged to the body for movement between an open and a closed position, a terminating chamber in the body which is adapted to receive an insulation displacement portion of a terminal, said cover having an aperture which extends through the cover and which aligns with the terminating chamber of the body when the cover is in a closed position, an operating member having one end initially disposed in the aperture of the cover and connected to the cover by frangible webs and an opposite end initially disposed outwardly of an outer surface of the cover, said operating member being displaceable into the terminating chamber when the cover is closed and the frangible webs are fractured for forcing an insulated conductor positioned between the cover and the insulation displacement portion of the terminal into the terminating chamber and into cooperative engagement with an insulation displacement portion of the terminal disposed therein, said operating member being separate from said cover after said frangible webs are fractured and having means cooperating with said body to retain the operating member in the terminating chamber after separation from the cover, and a sufficient spacing existing between the opposite end of the operating member and the aperture of the cover so that the cover may be opened when the operating member is retained in the terminating chamber.

2. The insulator housing as defined in claim 1 wherein the aperture which extends through the cover is near an edge of the cover so that the operating member can be actuated by a pair of pliers.

3. The insulator housing as defined in claim 2 wherein the opposite end of the operating member is substantially flush with the adjacent portion of the outer surface of the cover when the cover is closed and the operating member is retained in the terminating chamber.

4. The insulator housing as defined in claim 2 wherein the cover has an upstanding U-shaped guard wall for protecting the operating member against accidental separation prior to actuation.

5. An insulator housing for an insulation displacement terminal comprising;

a body and a cover integrally hinged to the body for movement between an open and a closed position, a terminating chamber in the body which has an insulation displacement portion of a terminal disposed therein, means on the body for retaining an insulated conductor adjacent the insulation displacement portion of the terminal when the cover is in an open position, said cover having an aperture which extends through the cover and which aligns with the terminating chamber when the cover is in a closed position, an operating member having one end initially disposed in the aperture of the cover and connected to the cover by frangible webs and an opposite end initially disposed outwardly of an outer surface of the cover, said operating member being displaceable into the terminating chamber when the cover is closed and the webs are fractured to force an insulated conductor between the cover and the insulation displacement portion of the terminal down into the terminating chamber and into cooperative engagement with the insulation displacement portion of the terminal disposed therein, and said operating member being separate from said cover after said frangible webs are fractured and having nib means at said one end cooperating with said body to retain the operating member in the terminating chamber after separation from the cover, and said operating member having an opposite end which is spaced sufficiently from said cover after separation so that the cover may be opened when the operating member is retained in the terminating chamber.

6. An insulator housing for an insulation displacement terminal comprising;

a body and a cover integrally hinged to the body member for movement between an open and a closed position, a terminal cavity in the body, a conductor channel in the body which communicates with the terminal cavity and which extends through at least one side of the body for passage of an insulated conductor;

a terminating chamber in the body at the juncture of the terminal cavity and the conductor channel which receives the insulation displacement portion of a terminal disposed in the terminal cavity, finger means on the body for retaining an insulated conductor adjacent the insulation displacement portion of the terminal when the cover is open, said cover having a groove in the inner surface of the cover which aligns the insulated conductor with the conductor channel when the cover is closed and, an aperture which through the cover via the groove and which aligns with the terminating chamber when the cover is closed, lock means to retain the cover in the closed position, an operating member having one end initially disposed in the aperture of the cover and connected to the cover by frangible webs and an opposite end initially disposed outwardly of the outer surface of the cover, said operating member being displaceable into the terminating chamber when the cover is closed and the frangible webs are fractured to force an insulated conductor between the cover and the terminating chamber into the terminating chamber terminal and into cooperative engagement with the insulation displacement portion of the terminal disposed therein, said operating member being separate from said cover after said frangible webs are fractured and having nib means at said one end cooperating with said body to retain the operating member in the terminating chamber after separation from the cover, and said operating member having an opposite end which is spaced sufficiently from said cover after separation so that the cover may be opened when the operating member is retained in the terminating chamber.

* * * * *